US006442776B1

(12) United States Patent
Oberdörfer

(10) Patent No.: US 6,442,776 B1
(45) Date of Patent: Sep. 3, 2002

(54) SANITARY APPLIANCE

(75) Inventor: Hans Oberdörfer, Stuttgart (DE)

(73) Assignee: Hansa Metallwerke AG (DE)

( * ) Notice: Subject to any disclaimer, the term of this patent is extended or adjusted under 35 U.S.C. 154(b) by 0 days.

(21) Appl. No.: 09/545,164

(22) Filed: Apr. 7, 2000

(30) Foreign Application Priority Data

Apr. 7, 1999 (DE) ..... 199 15 526

(51) Int. Cl.[7] ..... E03C 1/04

(52) U.S. Cl. ..... 4/677; 4/695; 285/321; 137/359

(58) Field of Search ..... 4/675, 677, 678, 4/695; 137/359, 801; 285/321

(56) References Cited

U.S. PATENT DOCUMENTS

| | | | | |
|---|---|---|---|---|
| 2,749,154 A | * | 6/1956 | Smith | 285/321 |
| 4,084,843 A | | 4/1978 | Gassert | 285/105 |
| 5,558,128 A | * | 9/1996 | Pawelzik et al. | 137/801 |
| 5,685,341 A | * | 11/1997 | Chrysler et al. | 137/801 |

FOREIGN PATENT DOCUMENTS

| | | |
|---|---|---|
| DE | 33 22 202 | 1/1984 |
| EP | 266 296 | 5/1988 |

OTHER PUBLICATIONS

English language Abstract of EP 937,828, Feb. 1999.*

English language Abstract of EP 472,022, Aug. 1991.*

English language Abstract of DE 3,513,840, Oct. 1986.*

* cited by examiner

*Primary Examiner*—Robert M. Fetsuga

(57) ABSTRACT

A sanitary appliance (1) has a location space (3), which is cut out of a housing (2) and intended for a cartridge (4) containing the control elements. A base (6) closes off the location space (3) in a downward direction. A water supply pipe (11) is detachably fastened in a bore (25) of the base (6). The water supply pipe (11) is axially locked by a conical tension spring (21) disposed in a location space (19) of the base (6). The tension spring (21) is applied by its smaller-diameter end with frictional engagement against the outer surface of the water supply pipe (11). With its larger-diameter end the tension spring (21) is supported against the base of the location space (19). The conical lateral surface of the tension spring (21) widens towards the outer end of the water supply pipe (11). In said manner, smooth water supply pipes may be fastened through simple insertion into the otherwise already completely assembled sanitary appliance.

7 Claims, 3 Drawing Sheets

SANITARY APPLIANCE

Figure 1:
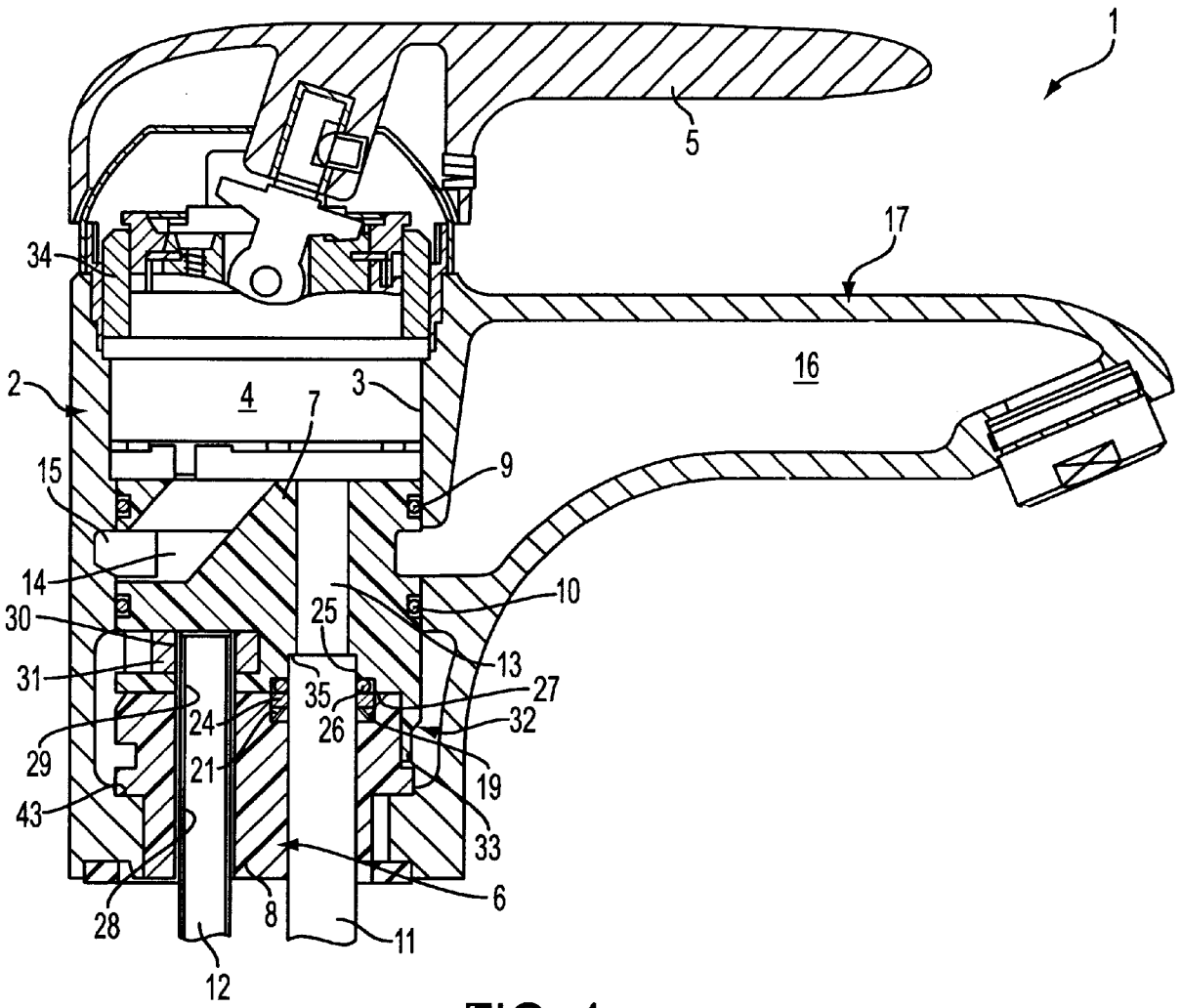

The invention relates to a sanitary appliance having a) a housing;

b) a location space cut out of the housing for a cartridge containing the control elements;

c) a base closing off the location space in a downward direction;

d) at least one water supply pipe fastened detachably in a bore of the base, and e) axial locking means for the water supply pipe.

Such a sanitary appliance is known from DE 31 19 313 C2. There, the locking means are formed by a collar, which is formed in the outer wall of the water supply pipe and rests against a shoulder in the base of the sanitary appliance so as to be axially locked thereby. The manufacture of such a collar on the water supply pipe involves an additional and hence expensive production stage. In addition, it is impossible for such a water supply pipe provided with a collar for axial locking purposes to be inserted from below into the base of the sanitary appliance. Said sanitary appliance therefore has to be delivered from the manufacturer with fully assembled water supply pipes.

A further sanitary appliance of the type described initially is known from DE 35 13 840 C2. There, the axial locking means are formed by a crossbar which, after the water supply pipes have been introduced, is driven through a transverse recess laterally into the base of the sanitary appliance and by virtue of the deformation of the water supply pipes produced thereby axially secures the latter. Here too, a final assembly of the sanitary appliance without water supply pipes is not possible.

The object of the present invention is therefore to develop a sanitary appliance of the type described initially in such a way that enables the subsequent fastening of water supply pipes with smooth outer lateral surfaces to an otherwise already completely assembled sanitary appliance.

Said object is achieved according to the invention in that f) the locking means comprise a conical tension spring, which is disposed in a location space of the base, is applied by its smaller-diameter end with frictional engagement against the outer surface of the water supply pipe and is supported by its larger-diameter end against the base of said location space;

whereby g) the conical lateral surface of the tension spring widens towards the outer end of the water supply pipe.

The tension spring may be disposed in the preassembled sanitary appliance prior to fastening of the water supply pipes. Once the water supply pipe is inserted, the tension spring acts as a friction brake and, because it is supported via the base of the location space against the sanitary appliance, prevents the water supply pipe from sliding out of the location bore. The orientation of the cone opening of the tension spring means, on the one hand, that the water supply pipe may be inserted with a low expenditure of force into the sanitary appliance but, on the other hand, that a secure fastening of the water supply pipe arises owing to the fact that, in the event of a pulling motion, the retaining force of the tension spring increases. The assembly of smooth water supply pipes, i.e. of water supply pipes without specially designed fastening projections, is therefore possible.

Thus, the time taken for final assembly of the sanitary appliance in situ, e.g. on a washstand, is also markedly reduced because all that remains to be done is to insert the water supply pipes, which may already be connected to the domestic water system, into the otherwise completely assembled sanitary appliance.

The locking means may comprise a retaining body, which rests axially against the tension spring in such a way that the tension spring is axially locked in its location space. Through the use of such a retaining body, the geometry of the base of the sanitary appliance may be simplified. It is thereby possible, for example, to manufacture the location space without forming undercuts in the base.

The retaining body is preferentially a ring surrounding the water supply pipe.

There may be disposed between the retaining body and the above-lying part of the sanitary appliance a sealing ring, which is axially compressed by the retaining body and the above-lying part. By virtue of the axial compression a prestressing of the sealing ring is achieved such that, upon insertion of the water supply pipe, the sealing ring is applied radially in a sealing manner around the water supply pipe.

The base may comprise two base parts and the location space for the conical tension spring may be disposed in the region of the boundary surface of the two base parts. Thus, easy access to the location space, into which the tension spring and retaining body are inserted, is guaranteed.

In a preferred embodiment, the base comprises a space for receiving a nut, into which a thread of an assembly bolt extending outwards through a bore of the base engages. The resultant effect is that the assembly bolt, which may take the form of a simple threaded rod, may also be introduced subsequently into the already completely assembled sanitary appliance and fastened to the latter. The otherwise completely assembled sanitary appliance may then be delivered entirely without troublesome, downward projecting pin or pipe elements, which markedly reduces the packaging outlay.

The base and the cartridge may form a structural unit, from which the housing is removable without dismantling the sanitary appliance from its supporting installation surface. The "insides" of the sanitary appliance are therefore easily accessible e.g. for maintenance purposes. If, for example, a leak arises between structural elements of the sanitary appliance, the housing may, without any other assembly steps, be removed and replaced after the repair has been carried out.

Figure 2:
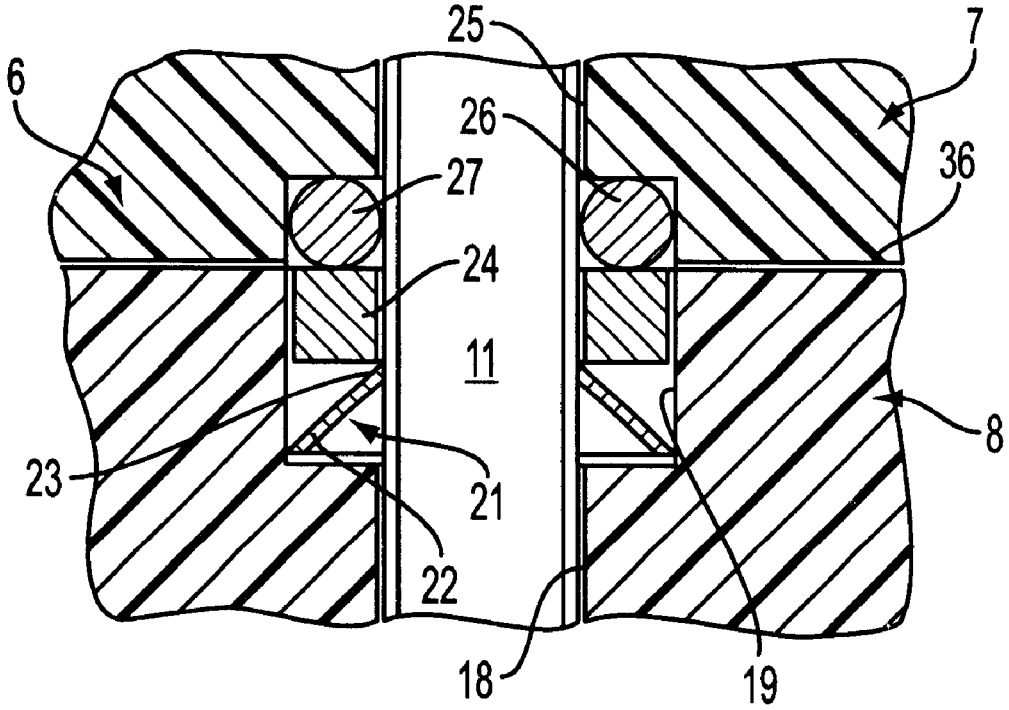
Figure 3:
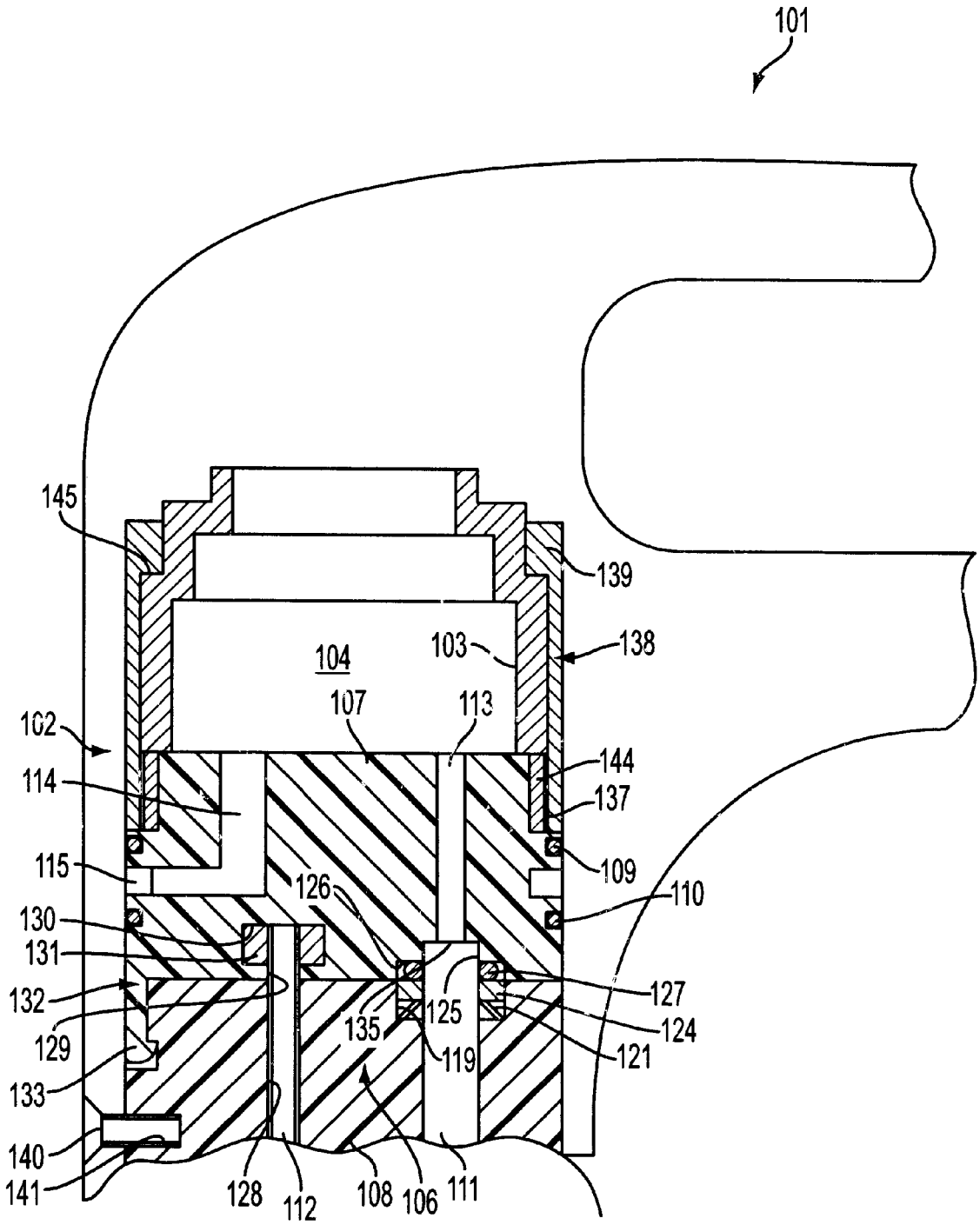

There now follows a detailed description of embodiments of the invention with reference to the drawings; the drawings show:

FIG. 1 a section through a sanitary appliance;

FIG. 2 an enlarged cutout from FIG. 1 showing a portion of a water supply pipe between two base parts of the sanitary appliance; and FIG. 3 a partial section through an alternative embodiment of the sanitary appliance.

FIG. 1 shows a sanitary appliance denoted as a whole by the reference character 1. Situated in its housing 2 is a location space 3 for a control cartridge 4. The latter houses the control elements (not shown), which may be operated by means of a handle 5 for selecting the quantity and temperature of the water. The location space 3 is closed off in a downward direction by a base 6, which may be assembled as a unit, comprises a top base part 7 and a bottom base part 8 and is described in greater detail further below. Two O-ring seals 9, 10 provided at the periphery of the base 6 ensure that the latter is sealed against the housing 2.

Extending through the bottom base part 8 are two water supply pipes 11, of which only one is shown in FIG. 1, as well as an assembly bolt 12 made of metal. In the top base part 7 the water supply pipes 11 open into connecting channels 13, via which the water flowing in through the water supply pipes 11 is supplied to the control cartridge 4. The top base part 7 further comprises a mixed water channel 14. Via the latter the water, which has been throttled and mixed in the desired manner and passes out of the control cartridge 4, is supplied to an annular chamber 15, which is delimited by the top base part 7 and the housing 2, and from there to the outlet chamber 16 inside an outlet 17.

The base parts 7 and 8 are manufactured from an optionally fibre-reinforced plastic material.

The two base parts 7 and 8, prior to installation in the housing 2, are preassembled in a manner yet to be described and introduced as a unified base 6 into the housing 2. Both the water supply pipe 11 and the assembly bolt 12 may then be assembled in the manner described below.

First, the fastening of the water supply pipe 11 is considered with reference to FIGS. 1 and 2 (the second water supply pipe 11 not visible in said drawings is assembled in a corresponding manner).

A through-bore 18 in the bottom base part 8 for receiving the water supply pipe 11 widens at its—in FIGS. 1 and 2—top end, which is directed towards the top base part 7, into a region 19 of a larger diameter. The space formed by the region 19 accommodates a commercially available, conical tension spring 21, which coaxially surrounds the water supply pipe 11. The conical lateral surface of the tension spring 21 widens towards its—in the drawing—bottom end region 22, where it has an opening with an outside diameter substantially corresponding to the diameter of the region 19 of the through-bore 18. With its end region 22 the tension spring 21 is supported against the edge of the region 19 formed by the peripheral wall and the bottom wall. From the end region 22 the conical lateral surface of the tension spring 21 extends—in the drawing—obliquely up towards an end region 23, against the opening of which the lateral surface of the water supply pipe 11 rests.

The region 19 of the through-bore 18 additionally accommodates an annular retaining ring 24, which is disposed above the tension spring 21 and likewise coaxially surrounds the water supply pipe 11. The inside diameter of the retaining ring 24 is in said case slightly greater than the outside diameter of the water supply pipe 11.

In the illustrated assembled state of the base 6, the tension spring 21 is positioned by the retaining ring 24 in the region 19 such that the tension spring 21 has no end play inside the region 19.

The top base part 7 likewise has a through-bore 25 for receiving a top region of the water supply pipe 11. At the—in FIGS. 1 and 2—bottom end of the through-bore 25 directed towards the bottom base part 8, the through-bore has a region 26 of a larger diameter. Inserted in the space formed by the region 26, the water supply pipe 11 and the retaining ring 24 is an O-ring seal 27, which coaxially surrounds the water supply pipe 11.

In the completely assembled state, the O-ring seal 27 seals off the water supply pipe 11, the top base part 7 and the retaining ring 24 from one another.

The assembly bolt 12 is passed through a through-bore 28 of the bottom base part 8 and fastened to the top base part 7. To said end, the top base part 7 has a bore 29, which is aligned with the through-bore 28 and opens into a space 30 for receiving a nut 31. The space 30 is open towards the lateral surface of the top base part 7 so that the nut 31 may be introduced from the side. The—in the drawing—top end of the assembly bolt 12 has an external thread corresponding to the internal thread of the nut 31 and is screw-connected to the latter.

The two base parts 7 and 8 are firmly connected to one another by mechanical positive engagement. This is effected by means of three snap connections 32, which are distributed over the periphery of the base 6 and of which only one is shown in FIG. 1. For said purpose, the top base part 7 has resilient hooks 33, which extend beyond the boundary surface between the two base parts 7 and 8 in the direction of the bottom base part 8 and of which the heads are offset inwards relative to the longitudinal axis of the base 6 and engage into corresponding recesses of the base part 8 of a complementary shape thereto.

Assembly of the sanitary appliance 1 is effected as follows:

First, the two base parts 7, 8 are brought into a position, in which their bores for the water supply pipes 11 and the assembly bolt 12 are mutually aligned, and are latched to one another by means of the snap connections 32. During latching of the base parts 7, 8, the O-ring seal 27 is axially clamped. The base 6 thus assembled may then be introduced from above into the housing 2 until it comes into contact with a shoulder of a bottom constriction 43 of the housing 2 and is therefore locked in axial direction.

After latching of the snap connections 32, the base parts 7, 8 are in mutual contact at their adjacent end faces. In said case, the top base part 7 simultaneously rests against the top surface of the retaining ring 24, which in turn rests on the—in the drawing—top end region 23 of the tension spring 21, so that the axial position of the tension spring 21 is secured.

The control cartridge 4 is then introduced likewise from above into the housing 2 and held in contact with the base 6 by means of a screw part 34, which is subsequently screwed into an above-lying threaded opening of the housing 2. Said almost completely assembled sanitary appliance 1 (still without water supply pipe 11 and assembly bolt 12) forms a handy and less awkwardly shaped unit.

For final assembly of the sanitary appliance 1, e.g. on a washstand, first the nut 31 is brought from the side into the space 30 and then the assembly bolt 12 is introduced from below through the through-bore 28 into the base 6 and screw-connected to the nut 31. By means of the threaded portion of the assembly bolt 12 protruding from the bottom base part 8, a screw connection to suitable fastening means on the washstand is then possible.

The water supply pipes 11 are then introduced from below into the bores 18 of the base 6 until the—in FIG. 1—top end of the water supply pipes 11 abuts a shoulder 35, which is formed by the transition from the through-bore 25 of the top base part 7 to the narrower connecting channels 13.

The top end region of the tension spring 21, as the water supply pipe 11 is pushed through, is radially slightly expanded by the peripheral wall of the water supply pipe 11. The tension spring 21 then acts, in the latched state of the base parts 7 and 8, as a friction brake for the water supply pipe.

Because of the conical shape of the tension spring 21 its action as a friction brake is highly direction-dependent. Thus, the tension spring 21 sets a high friction force against an, in FIG. 1, downward pulling motion upon the water supply pipe 11 while a pushing motion effected in the opposite direction, which occurs during insertion of the water supply pipe 11 into the base 6, is braked relatively weakly. The stronger the downward pull on the water supply pipe 11, the more tightly the tension spring 21 is clamped against the water supply pipe 11.

In the alternative embodiment of a sanitary appliance 101 shown in FIG. 3, structural elements corresponding to the structural elements described above are provided with reference characters increased by 100 and are not separately described again.

In said embodiment, a base 106 and a control cartridge 104 are connected to one another to form a unit.

An external thread 137 of an injection-moulded insert 144 is provided, in said embodiment, on a top base part 107 of the base 106. A complementary internal thread on the end of a retaining ring 138 directed towards the base 106 engages into the thread 137. The retaining ring 138 substantially surrounds the outer peripheral region of the control cartridge 104 and has at its end region remote from the base 106 a retaining rim 139 of reduced diameter, which engages into a corresponding shoulder 145 in the outer surface of the control cartridge 104. The control cartridge 104 is therefore held down against the base 106 by the retaining ring 138 screw-connected to the base 106. Said holding-down function is therefore performed not, as in the initially described embodiment, by the housing 102, which is only indicated as an outline in FIG. 3.

The fastening nut 131 for the assembly bolt 112 in said embodiment is injection-moulded in the top base part 107.

The housing 102 is fastened to the bottom base part 108 with the aid of a radially extending screw 140, the screw head of which is sunk in a suitable bore 141 in the peripheral wall of the housing 102 and the thread of which engages into a complementary thread of the bottom base part 108.

What is claimed is:

1. A sanitary appliance having a) a housing;

b) a region cut out of the housing spaced from a cartridge containing control elements;

c) a base closing off the region in a downward direction;

d) at least one water supply pipe fastened detachably in a bore of the base, and e) axial locking means for the water supply pipe, wherein f) the axial locking means comprise a conical tension spring, which is disposed in the region, is applied by its smaller-diameter end with frictional engagement against the outer surface of the water supply pipe and is supported by its larger-diameter end against the base in the region; wherein g) the lateral surface of the conical tension spring widens towards the outer end of the water supply pipe, h) the water supply pipe being inserted with a low force into the sanitary appliance, the water supply pipe being secured in the sanitary appliance by the conical tension spring, the conical tension spring having a retaining force that increases against the water supply pipe in response to a pulling motion, and the water supply pipe being withdrawn from the sanitary appliance with a force larger than said low force required to insert the water supply pipe into the sanitary appliance.

2. A sanitary appliance as claimed in claim 1, wherein the locking means comprise a retaining body, which rests axially against the tension spring such that the tension spring is axially locked in its location space.

3. A sanitary appliance as claimed in claim 2, wherein the retaining body is a ring surrounding the water supply pipe.

4. A sanitary appliance as claimed in claim 2, wherein disposed between the retaining body and the above-lying part of the sanitary appliance is a sealing ring, which is compressed axially by the retaining body and the above-lying part.

5. A sanitary appliance as claimed in claim 1, wherein the base comprises two base parts and the location space for the conical tension spring is disposed in the region of the boundary surface of the two base parts.

6. A sanitary appliance as claimed in claim 1, wherein the base comprises a space for receiving a nut, into which a thread of an assembly bolt extending outwards through a bore of the base engages.

7. A sanitary appliance as claims in claim 1, wherein the base and the cartridge form a structural unit, from which the housing is removable without dismantling the sanitary appliance from its supporting installation surface.

* * * * *